US010709212B1

(12) United States Patent
Bharadwaj

(10) Patent No.: US 10,709,212 B1
(45) Date of Patent: Jul. 14, 2020

(54) MAGNETIC CLOSURES

(71) Applicant: Apple Inc., Cupertino, CA (US)

(72) Inventor: Shravan Bharadwaj, San Jose, CA (US)

( * ) Notice: Subject to any disclaimer, the term of this patent is extended or adjusted under 35 U.S.C. 154(b) by 76 days.

(21) Appl. No.: 15/209,308

(22) Filed: Jul. 13, 2016

Related U.S. Application Data

(60) Provisional application No. 62/245,770, filed on Oct. 23, 2015.

(51) Int. Cl.

| | |
|---|---|
| ***A44B 19/42*** | (2006.01) |
| ***A44B 19/08*** | (2006.01) |
| ***A45C 13/00*** | (2006.01) |
| ***A41F 1/00*** | (2006.01) |
| ***H01F 13/00*** | (2006.01) |
| ***A44B 19/16*** | (2006.01) |

(52) U.S. Cl.
CPC ..... *A44B 19/42* (2013.01); *A41F 1/002* (2013.01); *A44B 19/08* (2013.01); *A44B 19/16* (2013.01); *A45C 13/00* (2013.01); *H01F 13/003* (2013.01); *A44D 2203/00* (2013.01)

(58) Field of Classification Search
CPC ..... A44B 19/08; A44B 19/16; A41F 1/002; A45C 13/00; A44D 2203/00
See application file for complete search history.

(56) References Cited

U.S. PATENT DOCUMENTS

| | | | | |
|---|---|---|---|---|
| 3,591,914 A * | 7/1971 | Heimberger | ..... | A44B 19/26 29/408 |
| 3,735,454 A * | 5/1973 | Goldstein | ..... | A44B 19/04 24/411 |
| 4,399,595 A * | 8/1983 | Yoon | ..... | A41F 1/002 24/303 |
| 4,580,321 A * | 4/1986 | Tanikawa | ..... | A44B 19/32 24/389 |

(Continued)

OTHER PUBLICATIONS

"Dot Connector: New Technology of Elastomeric Connector", Polymatech, 20 pages.

(Continued)

*Primary Examiner* — Robert Sandy
*Assistant Examiner* — Rowland Do
(74) *Attorney, Agent, or Firm* — Treyz Law Group, P.C.; Kendall W. Abbasi

(57) ABSTRACT

An item may be provided with a body that forms an enclosure. The body may have a body portion that opens and closes along a seam. An elongated magnetic fastener may run along the seam. The magnetic fastener may have first and second strips of elastomeric material on opposing sides of the seam. Magnetic interlocking elements may be partially embedded in the first and second elastomeric strips. The fastener may be formed by injecting uncured elastomeric material having unmagnetized magnetic particles into a mold. While in the mold, a magnetic field may be applied to magnetize the magnetic particles and to align the magnetic particles into magnetized structures. After forming the (Continued)

magnetized structures within the elastomeric material, the elastomeric material may be cured. Once removed from the mold, portions of the elastomeric material may be removed to expose the magnetized structures, which may subsequently be shaped into interlocking fastener elements.

18 Claims, 8 Drawing Sheets

(56) References Cited

U.S. PATENT DOCUMENTS 4,598,883 A * 7/1986 Suter ..... B64F 1/005 150/166
5,129,127 A * 7/1992 Hamatani ..... A44B 19/34 24/393
2002/0129470 A1* 9/2002 Kiely ..... A44B 19/38 24/433
2006/0282995 A1* 12/2006 Liou ..... A44B 19/32 24/389
2007/0277353 A1* 12/2007 Kondo ..... A41F 1/002 24/403
2011/0113596 A1* 5/2011 Williams ..... A44B 19/12 24/381
2011/0302749 A1* 12/2011 Yazbeck ..... A44B 19/04 24/405
2012/0023713 A1* 2/2012 Williams ..... A44B 19/32 24/398
2012/0216374 A1* 8/2012 Manuello ..... A41F 1/002 24/303
2013/0061436 A1* 3/2013 Peters ..... A44B 99/00 24/430
2014/0050349 A1 2/2014 Groset et al.
2015/0135409 A1* 5/2015 Mongan ..... A41F 9/00 2/312
2015/0201718 A1* 7/2015 Fujii ..... A44B 19/32 24/389
2015/0216266 A1* 8/2015 Franklin ..... A41F 1/02 24/306
2015/0287561 A1* 10/2015 Levesque ..... A45C 13/1069 190/100

OTHER PUBLICATIONS

Walker et al., U.S. Appl. No. 15/136,725, filed Apr. 22, 2016.
Bharadwaj et al., U.S. Appl. No. 15/163,993, filed May 25, 2016.
"Silicones with Magnetic Properties", Wacker Chemie AG, 3 pages. Retrieved from the Internet:<URL:http://www.wacker.com/cms/en/wacker_group/innovations/magazine2013/silicone_mit_magnete%EF%AC%80ekt/siliconemitmagnete%EF%AC%80ekt_printpage.jsp> [retreived on Oct. 7, 2015].

* cited by examiner

MAGNETIC CLOSURES

This application claims the benefit of provisional patent application No. 62/245,770, filed Oct. 23, 2015, which is hereby incorporated by reference herein in its entirety.

BACKGROUND

This relates generally to items formed from flexible material such as fabric-based items and, more particularly, to integrating magnetic closures into items formed from layers of flexible material.

Zippers are commonly used as closures for bags, garments, and other items formed from fabric. Some zippers are formed from discrete interlocking elements mounted on fabric tape. For example, plastic elements may be molded onto a fabric tape or metal elements may be crimped onto a fabric tape. In coil zippers, a coiled monofilament is processed to form interlocking teeth. Coil zippers can be sewn to a fabric tape.

Zippers on fabric tape can be sewn to pieces of fabric or layers of other flexible materials such as leather or plastic. The pieces of fabric or other flexible material may form portions of a garment, the sides of a bag, or other items that use zippers.

Conventional zippers mounted on fabric tape can be unsightly. The tape on which the zipper is mounted may be too soft or too stiff relative to the fabric or other flexible material to which the tape is sewn, leading to wrinkles and other disruption to the flexible material when the zipper is used. Zippers may sometimes snag on portions of the tape or portions of the flexible material. Conventional zippers can also be cumbersome to use, often requiring more than one hand to open and close.

It would therefore be desirable to be able to provide improved closures for fabric, leather, and other layers of flexible material.

SUMMARY

An item such as a bag that encloses an interior cavity or a garment may be formed from a flexible layer having portions that are coupled with a zipper. The flexible layer may be formed from a fabric, a material such as leather or plastic, or other flexible material.

A zipper may be formed from magnetic elements that are attracted to one another. One side of the seam may have a first set of magnetic zipper teeth that attracts a second set of magnetic zipper teeth on an opposing side of the seam.

The magnetic zipper elements may be co-molded with an elastomeric material to form a flexible, robust seam. An uncured elastomeric material such as silicone may be placed in a mold. Unmagnetized magnetic particles may be embedded in the uncured elastomeric material. A magnetic field may be applied while the material is in the mold to magnetize the magnetic particles. The magnetized particles may then be aligned and bonded together to form magnetized clusters by adjusting the applied magnetic field.

Following magnetization and alignment, the elastomeric material may be cured. During the curing process, the clusters of magnetic particles may bond with surrounding elastomeric material to form a robust mechanical connection without airgaps.

After removing the mold, the elastomeric material and/or the magnetic clusters may be machined or otherwise shaped to form the desired interlocking geometry for the magnetic zipper.

DETAILED DESCRIPTION

Magnetic material may be used in forming electronic devices, may be used in forming accessories such as covers, straps, and bags that are associated with electronic devices, may be used in forming fabric for electronic devices and accessories, may be used in forming fabric that is incorporated into seating, furniture, building structures, and other items, and/or may be used in forming other items. Configurations in which magnetic material is used in forming items based on one or more strands of magnetic material may sometime be described herein as an example. The strands of material may be monofilaments of material and/or may be multifilament strands such as strands of yarn. Strand-based items may be formed from intertwined strands such as woven strands, knitted strands, braided strands, strands that have been intertwined to form felt, or other intertwined strands (fabric, etc.).

Magnetic material may be magnetized to form permanent magnets. Permanent magnets may interact with each other. For example, permanent magnets may be arranged to attract each other or to repel each other. Electromagnets may be electrically configured to either attract or repel a permanent magnet. Unmagnetized magnetic material (e.g., ferromagnetic material or ferromagnetic material that has not been magnetized by application of an external magnetic field to form a permanent magnet) may also interact with permanent magnets and electromagnets. For example, a permanent magnet may attract a fabric or other structure formed from strands of unmagnetized magnetic material based on a rare earth alloy such as a neodymium alloy (e.g., NdFeB).

Figure 1A:
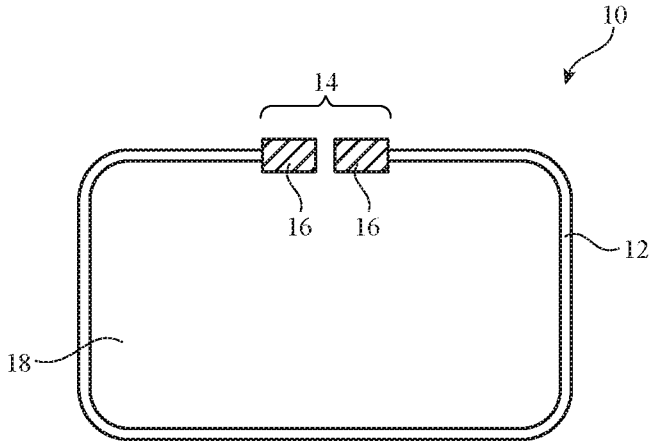
FIG. 1A is a cross-sectional side view of an illustrative item with a zipper in a closed position in accordance with an embodiment.

Zippers may include magnetic elements. Zippers may be used as closures in garments, bags, and other items. An illustrative item that may be provided with a magnetic zipper is shown in the cross-sectional side view of FIG. 1A. As shown in FIG. 1A, item 10 may have zipper 14. Zipper 14 may have first and second opposing sets of interlocking teeth 16. Item 10 may be a garment, a bag, or other item. Item 10 may include a body having an interior 18 and having a body portion such as body portion 12 that opens and closes along a seam to provide access to interior 18 from outside the body through an opening. Body portion 12 may be formed from one or more flexible layers of material and may sometimes be referred to as flexible layer 12. For example, item 10 may be a bag in which flexible layer 12 surrounds and encloses interior cavity 18. Other types of items may be provided with zippers such as zipper 14 if desired. The example of FIG. 1A is merely illustrative.

Flexible layers for item 10 such as flexible layer 12 may be formed from sheets of plastic, layers of fabric, leather, paper, or other flexible material. Fabric may be formed from strands of plastic, metal, other materials, and combinations of these materials. The strands may be monofilaments or multifilament strands and may include materials such a plastic, metal, and other materials.

Figure 1B:
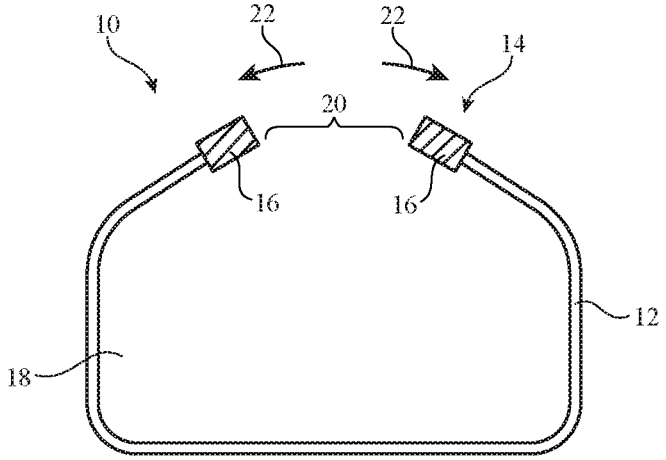
FIG. 1B is a cross-sectional side view of the illustrative item of FIG. 1A with the zipper in an open position in accordance with an embodiment.

As shown in FIG. 1B, when zipper 14 is opened, zipper teeth 16 may be separated in directions 22 to form opening 20 in item 10 (e.g., an opening that allows objects to be inserted into interior cavity 18 or removed from cavity 18). Flexible layer 12 may form part of a garment, may form a sidewall in an item such as the sides of the bag of FIG. 1B, may form part of a strap or band that is worn or is used to carry a bag, or may be used to form other portions of item 10.

Figure 2:
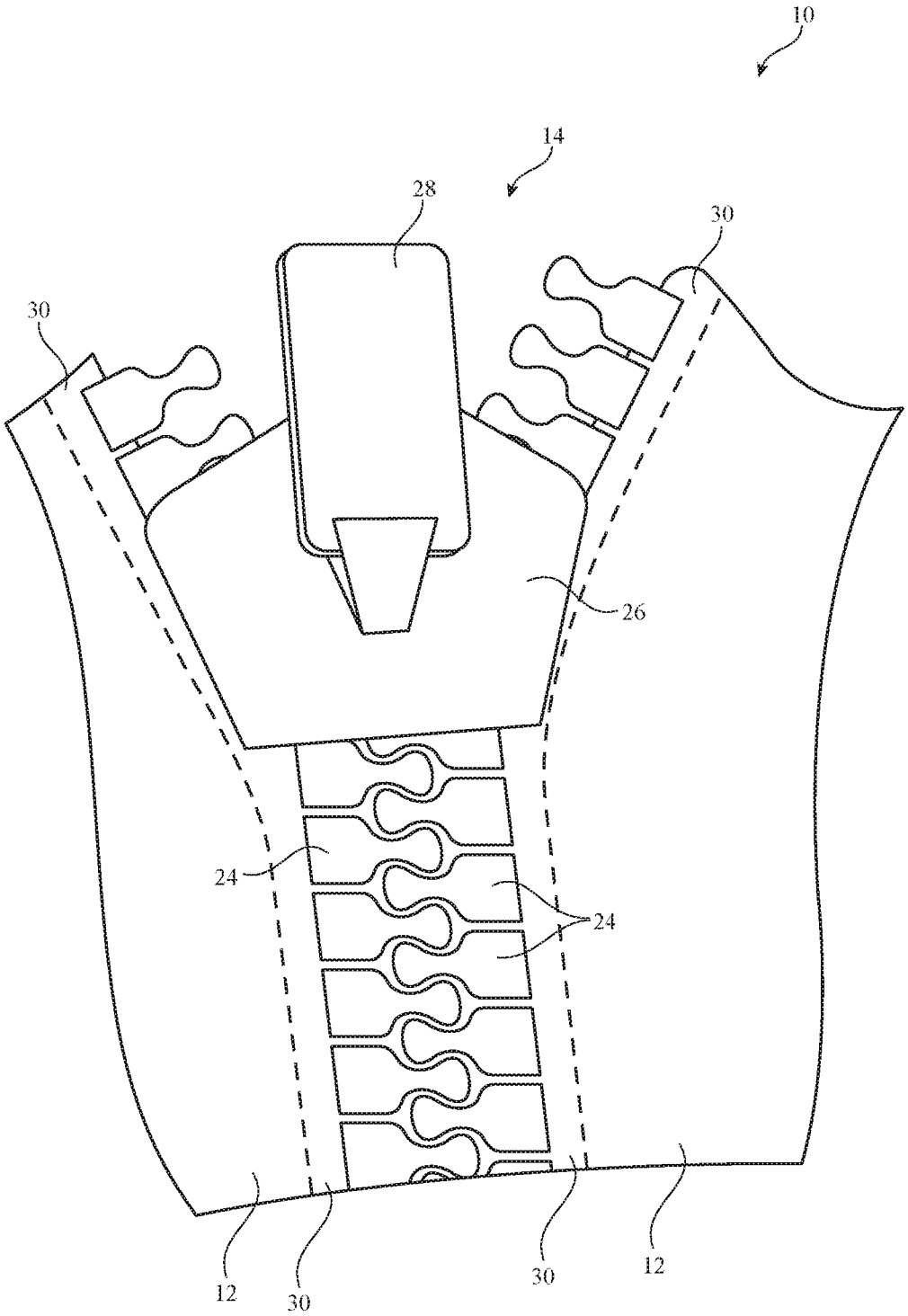
FIG. 2 is a diagram of an illustrative zipper with discrete elements in accordance with an embodiment.

As shown in FIG. 2, zipper 14 may be formed from two interlocking sets of discrete zipper elements 24. Zipper elements 24 may be formed from plastic, metal, other materials, or combinations of these materials. Zipper elements 24 may be formed along the edges of opposing portions of flexible layer 12. Slider 26 may be moved along the length of zipper 14 using pull 28. Slider 26 may contain a Y-shaped channel that can separate and join the two opposing halves of zipper 14 (e.g., the right and left sets of elements 24 in the example of FIG. 2). Although the two halves of flexible layer 12 of FIG. 2 are shown as being mated by bending flexible layer 12 within the plane of flexible layer 12, other zipper geometries may be used (e.g., edge portions of layer 12 along zipper 14 may overlap each other, so that flexible layer 12 bends out of the plane of layer 12 when using zipper 14).

Zipper elements 24 may be partially embedded in an elastomeric material such as elastomeric strip 30. Zipper elements 24 may be formed from magnetic material that is co-molded with elastomeric material 30 so that the magnetic material 24 is bonded at the atomic level with surrounding elastomeric material 30. Integrating magnetic zipper elements 24 with elastomeric strip 30 in this way creates a robust closure that can open and close with minimum effort while providing a flexible seam between flexible layers 12 of item 10. Zipper 14 may be attached to flexible layer 12 using molding techniques, crimping, sewing, adhesive-based mounting techniques, weaving, knitting, and other attachment techniques.

Figure 3:
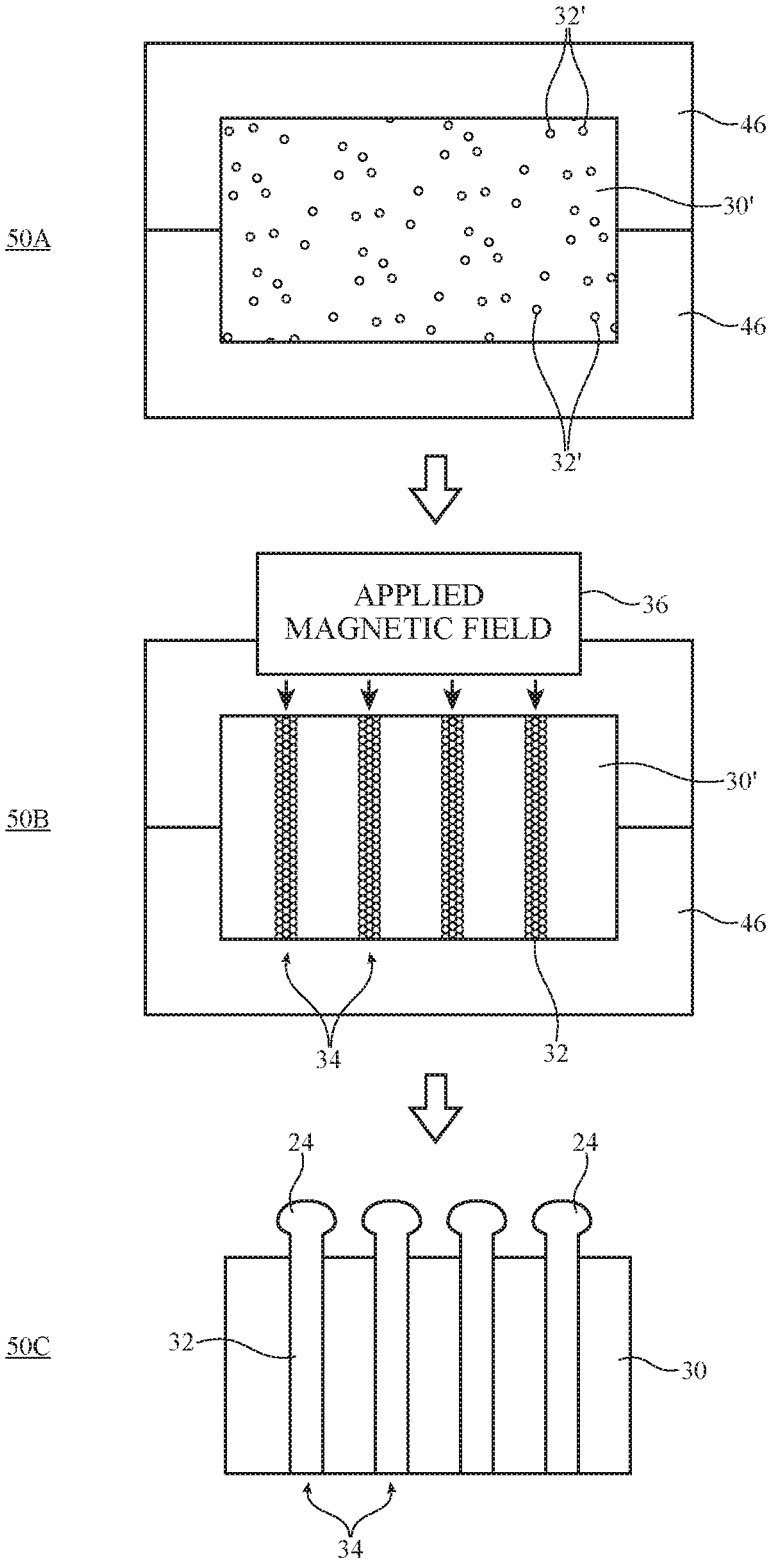
FIG. 3 showing how magnetic material may be co-molded with an elastomer and magnetized to form magnetic elements of a desired shape in accordance with an embodiment.

FIG. 3 is a diagram of illustrative steps involved in forming a magnetic closure of the type shown in FIG. 2. As shown in FIG. 3, uncured elastomeric material 30' (sometimes referred to as a host material) may contain unmagnetized magnetic particles 32' based on a rare earth alloy such as a neodymium alloy (e.g., NdFeB). Elastomeric material 30' may be an uncured silicone material or other elastomer. At step 50A, elastomeric material 30' with embedded particles 32' may be placed in a mold such as mold 46.

After injecting material 30' with particles 32' in mold 46, a magnetic field 36 may be applied to material 30' and particles 32' to create magnetized particles 32 (step 50B). Magnetic field 36 may be applied using a matrix of electromagnets, using one electromagnet, or using any other suitable number or type of magnets.

Once magnetized, particles 32 may be positioned and aligned within material 30' by appropriately controlling the strength and position of magnetic field 36. Magnetic particles 32 are aligned to form magnetic clusters 34 in which adjacent magnetic particles 32 atomically bond with one another within elastomeric material 30'. In the example of FIG. 3, clusters 34 of bonded magnetic particles 32 form vertical columns within elastomeric material 30'. This is, however, merely illustrative. If desired, magnetic particles 32 may be aligned in a horizontal direction (e.g., to form one or more horizontal rows). In general, clusters 34 of magnetic particles 32 may have any suitable shape, size, density, pitch, or magnetic strength. If desired, magnetic particles 32 may be aligned to form a single cluster 34 that extends horizontally through material 30'.

Following magnetization and alignment of particles 32, uncured elastomeric material 30' may be cured to form elastomeric material 30, and mold 46 may be removed (step 50C). Step 50C may also include shaping elastomeric material 30 and/or magnetic clusters 34 to form zipper elements 24 of a desired shape. Shaping operations may be performed using a computer-controlled cutting machine, laser cutting tools, or other suitable tools for removing portions of elastomeric material 30 and/or magnetic material 32. In the example of FIG. 3 portions of elastomeric material 30 are removed to expose the end portions of magnetic columns 34 and the end portions of columns 34 are shaped to form an interlocking shape (e.g., a round shape, recess, protrusion, rib, rail, cavity, key, or other suitable interlocking shape).

Figure 4:
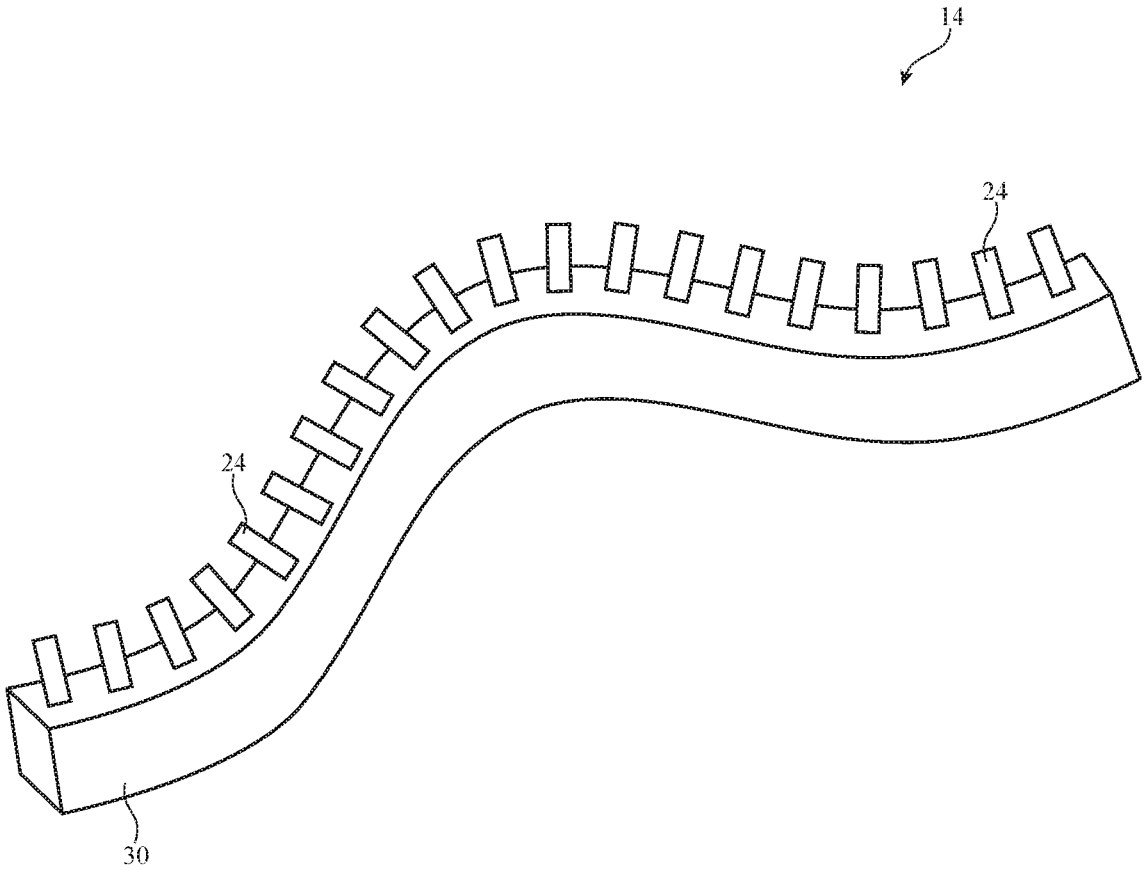
FIG. 4 is a perspective view of a portion of an illustrative closure having magnetic elements partially embedded in an elastomer in accordance with an embodiment.

FIG. 4 is a perspective view of a portion of a magnetic closure 14 formed using the approach of FIG. 3. As shown in FIG. 4, a portion of magnetic elements 24 may be embedded within elastomeric strip 30 and another portion of magnetic elements 24 may protrude out from elastomeric strip 30 to form interlocking zipper elements. The flexibility of elastomeric material 30' may allow may allow zipper 14 to form a closure on flexible materials such as fabric-based items. Because magnetic elements 24 are co-molded with elastomeric material 30, the mechanical coupling between elements 24 and material 30 may be both robust and seamless.

If desired, elements 24 may have an interlocking geometry of the type shown in FIG. 2. In that example, individual teeth on one side of the seam alternate and interlock with individual teeth on an opposing side of the seam when zipper 14 is closed. If desired, other zipper geometries may be used. FIGS. 5, 6, 7, and 8 show various zipper teeth geometry that may be formed using the method of FIG. 3.

Figure 5:
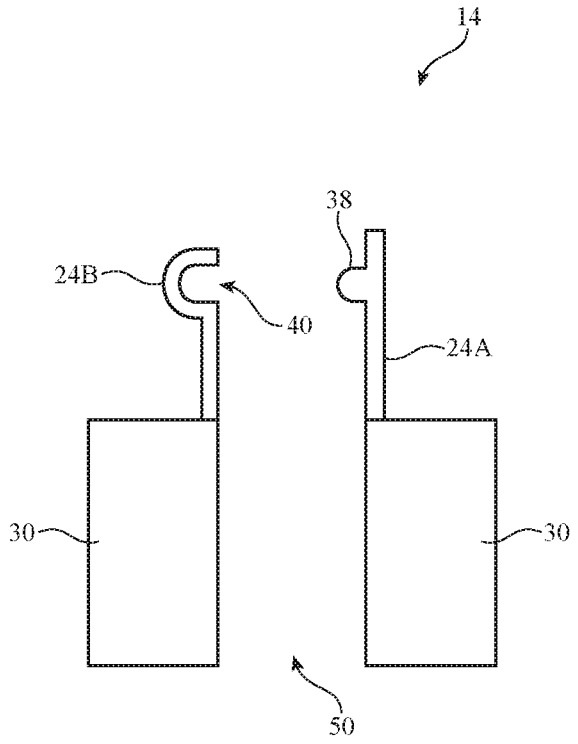
FIG. 5 is a cross-sectional side view of an illustrative magnetic closure in which a protrusion on one side of a seam is received by a recess on an opposing side of the seam in accordance with an embodiment.

In the example of FIG. 5, zipper element 24A on one side of seam 50 has a protrusion 38. Zipper element 24B on the opposing side of seam 50 has a recess 40 that receives protrusion 38. Because zipper elements 24A and 24B are magnetically attracted to one another, protrusion 38 may be guided to recess 40 by the magnetic attraction between elements 24A and 24B with little effort required by a user who is closing zipper 14.

Figure 6:
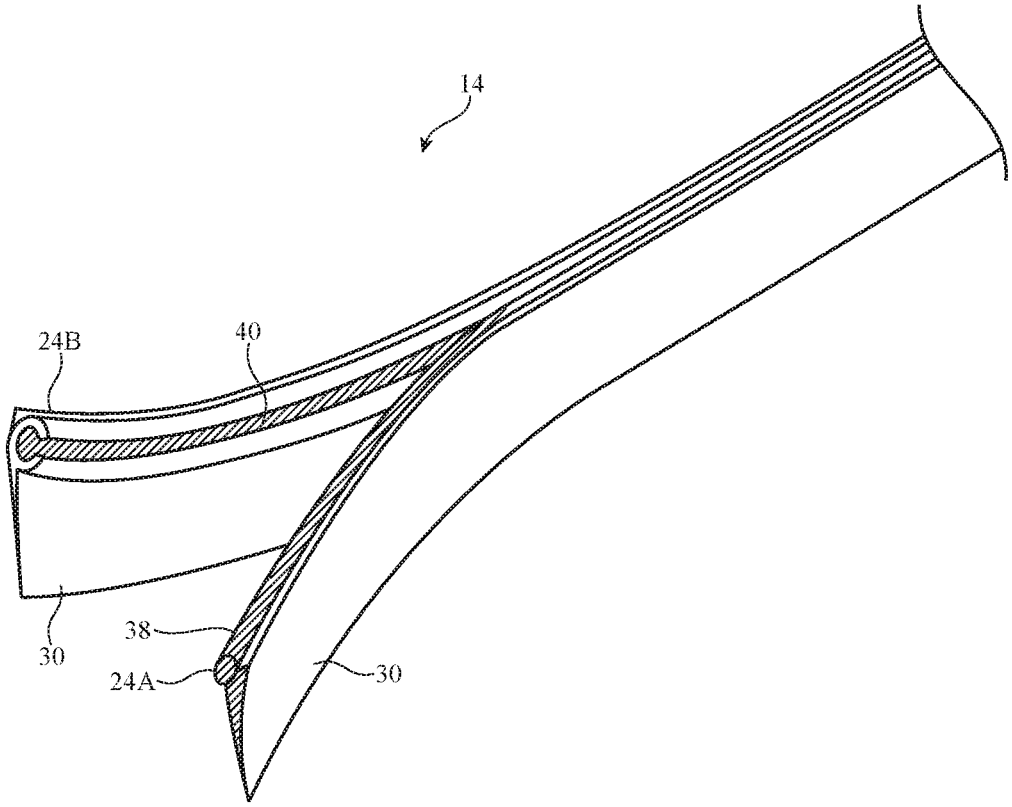
FIG. 6 is a perspective view of an illustrative magnetic closure in which a groove on one side of a seam receives an elongated rail on an opposing side of the seam in accordance with an embodiment.

In the example of FIG. 6, elements 24A and 24B have a cross-sectional geometry of the type shown in FIG. 5. In this example, however, element 24A is a single elongated protrusion 38 and element 24B is a single elongated recess 40. Elongated recess 40 may magnetically attract protrusion 38 to close zipper 14.

Figure 7:
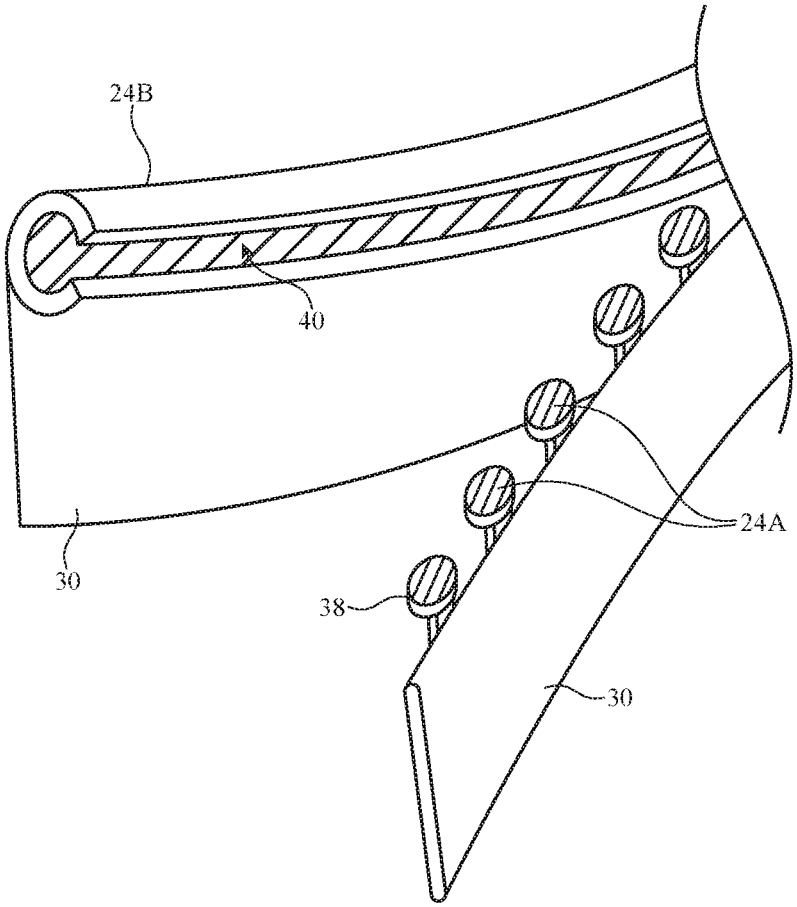
FIG. 7 is a perspective view of an illustrative magnetic closure in which a groove on one side of a seam receives a individual protrusions on an opposing side of the seam in accordance with an embodiment.

In the example of FIG. 7, elements 24A and 24B have a cross-sectional geometry of the type shown in FIG. 5. In this example, however, elements 24A are individual protrusions 38 and element 24B is a single elongated recess 40. Elongated recess 40 may magnetically attract individual protrusions 38 to close zipper 14.

Figure 8:
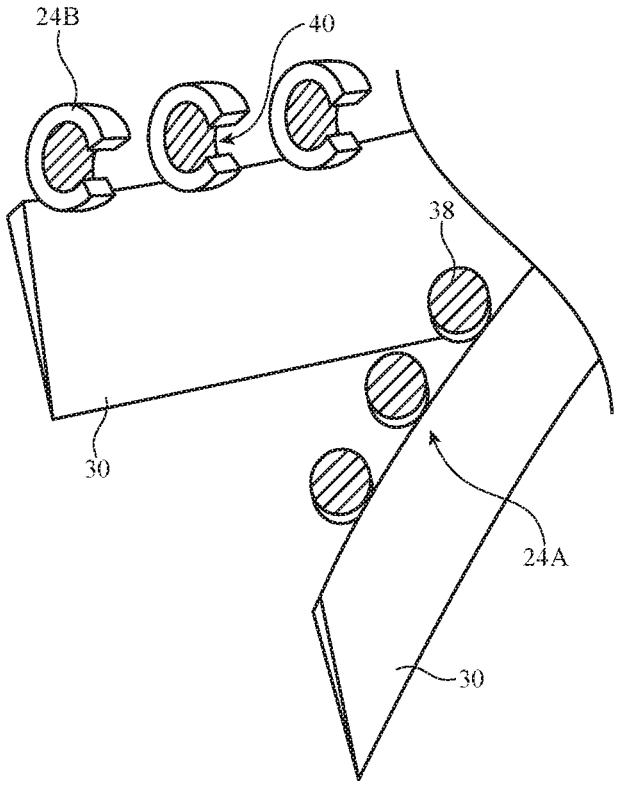
FIG. 8 is a perspective view of an illustrative magnetic closure in which recesses of individual elements on one side of a seam receive respective protrusions on an opposing side of the seam in accordance with an embodiment.

In the example of FIG. 8, elements 24A and 24B have a cross-sectional geometry of the type shown in FIG. 5. In this example, however, elements 24A are individual protrusions 38 and elements 24B are individual recesses 40. Each individual recess 40 may magnetically attract an associated one of protrusions 38 to close zipper 14.

What is claimed is:

1. An apparatus, comprising:

a body having an interior and having a body portion that opens and closes along a seam to provide access to the interior from outside the body through an opening in the body; and a fastener having a slider that moves up and down the seam to open and close the seam, wherein the fastener comprises:

a first strip of elastomeric material that extends continuously along a first side of the seam, a second strip of elastomeric material that extends continuously along a second side of the seam, a first group of magnetic elements each having a first portion that is embedded in the first strip of elastomeric material and a second portion that protrudes out of the first strip of elastomeric material, and a second group of magnetic elements each having a third portion that is embedded in the second strip of elastomeric material and a fourth portion that protrudes out of the second strip of elastomeric material and that interlocks with an associated one of the magnetic elements in the first group.

2. The apparatus defined in claim 1 wherein the body portion comprises a layer of fabric.

3. The apparatus defined in claim 2 wherein the layer of fabric has first and second edges on the first and second sides of the seam and wherein the first strip of elastomeric material extends along the first edge of the fabric and the second strip of elastomeric material extends along the second edge of the fabric.

4. The apparatus defined in claim 3 wherein the layer of fabric forms part of a bag.

5. The apparatus defined in claim 3 wherein the layer of fabric forms part of a garment.

6. The apparatus defined in claim 1 wherein the first group of magnetic elements are magnetically attracted to the second group of magnetic elements.

7. The apparatus defined in claim 1 wherein the first and second groups of magnetic elements form interlocking zipper teeth.

8. The apparatus defined in claim 1 wherein the elastomeric material comprises silicone.

9. The apparatus defined in claim 1 wherein the magnetic elements comprise neodymium.

10. An item, comprising:

fabric having first and second edges on either side of a seam; and a zipper that opens and closes the seam, the zipper comprising:

a first strip of elastomeric material along the first edge of the fabric and a second strip of elastomeric material along the second edge of the fabric;

a first magnetic element partially embedded in the first strip of elastomeric material and a second magnetic element partially embedded in the second strip of elastomeric material, wherein the first and second magnetic elements interlock with one another when the seam is closed and separate from one another when the seam is open; and a slider that slides along the seam to interlock the first and second magnetic elements.

11. The item defined in claim 10 wherein the first magnetic element comprises a recess and the second magnetic element comprises a protrusion that is received in the recess when the first and second elements are interlocked.

12. The item defined in claim 11 wherein the first magnetic element extends continuously along a length of the first strip of elastomeric material.

13. The item defined in claim 12 wherein the recess in the first magnetic element extends continuously along the length of the first strip of elastomeric material.

14. The item defined in claim 10 wherein the first magnetic element is one of a plurality of first magnetic elements partially embedded in the first strip of elastomeric material and wherein the second magnetic element is one of a plurality of second magnetic elements partially embedded in the second strip of elastomeric material.

15. The item defined in claim 10 wherein the elastomeric material in the first and second strips of elastomeric material comprises silicone.

16. The item defined in claim 10 wherein the first and second strips of elastomeric material are molded to the fabric.

17. The item defined in claim 10 wherein the first and second strips of elastomeric material are adhesively attached to the fabric.

18. The item defined in claim 10 wherein the fabric encloses a cavity and wherein the seam provides access to the cavity when the first and second magnetic elements are separated from one another.

* * * * *